US011920789B2

(12) United States Patent
Marusko et al.

(10) Patent No.: US 11,920,789 B2
(45) Date of Patent: Mar. 5, 2024

(54) COMBUSTOR ASSEMBLY FOR A TURBINE ENGINE

(71) Applicant: General Electric Company, Schenectady, NY (US)

(72) Inventors: Mark Willard Marusko, Springboro, OH (US); Michael Alan Stieg, Cincinnati, OH (US); Brian Christopher Towle, Leawood, KS (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/167,165

(22) Filed: Feb. 4, 2021

(65) Prior Publication Data

US 2021/0310657 A1 Oct. 7, 2021

Related U.S. Application Data

(62) Division of application No. 15/203,914, filed on Jul. 7, 2016, now Pat. No. 10,935,242.

(51) Int. Cl.

| | |
|---|---|
| ***F23R 3/60*** | (2006.01) |
| ***F23R 3/00*** | (2006.01) |
| ***F23R 3/50*** | (2006.01) |

(52) U.S. Cl.

CPC ..... *F23R 3/002* (2013.01); *F23R 3/007* (2013.01); *F23R 3/50* (2013.01); *F23R 3/60* (2013.01); *F23R 2900/00014* (2013.01)

(58) Field of Classification Search

CPC .. F02C 7/266; F23R 3/60; F23R 2900/00013; F23R 2900/00014

See application file for complete search history.

(56) References Cited

U.S. PATENT DOCUMENTS

| | | | | |
|---|---|---|---|---|
| 3,319,929 | A | 5/1967 | Lawrence et al. | |
| 3,910,036 | A * | 10/1975 | Irwin | F23R 3/007 60/753 |
| 5,353,587 | A | 10/1994 | Halila | |
| 6,438,940 | B1 * | 8/2002 | Vacek | F02C 7/266 60/204 |

(Continued)

FOREIGN PATENT DOCUMENTS

| | | | |
|---|---|---|---|
| CN | 105518389 | A | 4/2016 |
| EP | 1445537 | A2 | 8/2004 |

(Continued)

OTHER PUBLICATIONS

Combined Chinese Office Action and Search Report Corresponding to PCT201780042284 dated Mar. 3, 2020.

(Continued)

*Primary Examiner* — Thuyhang N Nguyen
(74) *Attorney, Agent, or Firm* — Dority & Manning, P.A.

(57) ABSTRACT

A combustor assembly for a gas turbine engine includes an outer liner that at least partially defines a combustion chamber. The outer liner extends between an aft end and a forward end generally along an axial direction within an outer casing of the gas turbine engine. The outer liner includes an inner surface facing the combustion chamber and an outer surface facing away from the combustion chamber. The combustor assembly includes a radial damper assembly disposed against the outer liner at a plurality of circumferential points.

20 Claims, 5 Drawing Sheets

(56) References Cited

U.S. PATENT DOCUMENTS

| | | | | |
|---|---|---|---|---|
| 6,442,929 | B1 * | 9/2002 | Kraft | F02C 7/266 60/39.827 |
| 6,904,757 | B2 | 6/2005 | Mitchell et al. | |
| 7,647,779 | B2 | 1/2010 | Shi et al. | |
| 7,849,696 | B2 | 12/2010 | DeSousa et al. | |
| 8,490,744 | B2 | 7/2013 | Nakamura et al. | |
| 8,529,197 | B1 | 9/2013 | Coffin et al. | |
| 8,702,377 | B2 | 4/2014 | Cottrell et al. | |
| 8,893,382 | B2 | 11/2014 | Patterson et al. | |
| 10,436,446 | B2 | 10/2019 | Dery | |
| 2005/0072163 | A1 * | 4/2005 | Wells | F23R 3/60 60/39.822 |
| 2011/0113748 | A1 * | 5/2011 | Lains | F02C 7/266 60/722 |
| 2011/0308654 | A1 * | 12/2011 | Bothien | F23M 20/005 138/31 |
| 2012/0180500 | A1 * | 7/2012 | DiCintio | F01D 9/023 29/888 |
| 2013/0195546 | A1 * | 8/2013 | Ponziani | F23R 3/60 403/327 |
| 2013/0280063 | A1 | 10/2013 | Ganiger et al. | |
| 2014/0109594 | A1 | 4/2014 | Casavant et al. | |
| 2014/0352316 | A1 * | 12/2014 | Fadde | F23R 3/002 60/757 |
| 2015/0075176 | A1 | 3/2015 | Ruthemeyer et al. | |
| 2016/0305325 | A1 * | 10/2016 | Cunha | F02C 7/264 |
| 2016/0369701 | A1 | 12/2016 | Pireyre et al. | |

FOREIGN PATENT DOCUMENTS

| | | | |
|---|---|---|---|
| EP | 1719949 | A2 | 11/2006 |
| FR | 3015642 | A1 | 6/2015 |
| GB | 1476414 | A | 6/1977 |
| JP | S52-87511 | A | 7/1977 |
| WO | WO2015/038274 | A1 | 3/2015 |

OTHER PUBLICATIONS

PCT International Search Report and Written Opinion corresponding to PCT/US2017/040003 dated Jan. 2, 2018.

Rotor Clip Company, Jan. 8, 2011, pp. 1-2. (Web Link Only) http://www.rotorclip.com/wave_spring_advantage1.php.

* cited by examiner

COMBUSTOR ASSEMBLY FOR A TURBINE ENGINE

CROSS REFERENCE TO RELATED APPLICATION

This Application is a divisional of U.S. patent application Ser. No. 15/203,914 entitled "COMBUSTOR ASSEMBLY FOR A TURBINE ENGINE", filed Jul. 7, 2016, which is hereby incorporated by reference herein in its entirety.

FIELD OF THE INVENTION

The present subject matter relates generally to a gas turbine engine, or more particularly to a combustor assembly for a gas turbine engine.

BACKGROUND OF THE INVENTION

A gas turbine engine generally includes a fan and a core arranged in flow communication with one another. In addition, the core of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gasses through the turbine section drives the turbine section and is then routed through the exhaust section, e.g., to the atmosphere.

More commonly, non-traditional high temperature materials, such as ceramic matrix composite (CMC) materials, are being used as structural components within gas turbine engines. For example, given the ability for CMC materials to withstand relatively extreme temperatures, there is particular interest in replacing components within the combustion section of the gas turbine engine with CMC materials. More particularly, one or more heat shields of gas turbine engines are more commonly being formed of CMC materials.

However, certain gas turbine engines have had problems accommodating certain mechanical properties of the CMC materials incorporated therein. For example, CMC materials may have limits for combinations of dynamic and static strain that are different from adjacent metallic hardware. Furthermore, differences between CMC and metal physical properties such as thermal expansion/contraction may lead to configurations that are not rigidly attached by traditional methods such as bolted flanges. These differences could potentially lead to portions of the CMC hardware exceeding the dynamic stress capability for given levels of static loading and temperature.

Accordingly, a combustor assembly capable of managing dynamic excitation non-metallic and metallic combustor elements would be useful. More particularly, a combustor assembly capable of managing dynamic excitation of a CMC heatshield and other CMC components of the combustion section would be particularly beneficial.

BRIEF DESCRIPTION OF THE INVENTION

Aspects and advantages of the invention will be set forth in part in the following description, or may be obvious from the description, or may be learned through practice of the invention.

In one aspect of the present disclosure, a combustor assembly for a gas turbine engine including an outer casing is provided. The gas turbine engine may define an axial direction. The combustor assembly may include a liner and a damper assembly. The liner may at least partially define a combustion chamber extending between an aft end and a forward end generally along the axial direction within the outer casing. The liner may include an inner surface facing the combustion chamber and an outer surface facing away from the combustion chamber. The damper assembly may extend between the outer casing and the outer surface of the liner. The damper assembly may include a selectively separable support and damper spring. The damper spring may be disposed between the support and the liner.

In another aspect of the present disclosure, a gas turbine engine defining an axial direction is provided. The gas turbine engine may include a compressor section, a turbine section, and a combustor assembly. The turbine section may be mechanically coupled to the compressor section through a shaft. The combustor assembly may be disposed between the compressor section and the turbine section. The combustor assembly may include a liner and a damper assembly. The liner may at least partially define a combustion chamber extending between an aft end and a forward end generally along the axial direction within the outer casing. The liner may include an inner surface facing the combustion chamber and an outer surface facing away from the combustion chamber. The damper assembly may extend between the outer casing and the outer surface of the liner. The damper assembly may include a selectively separable support and damper spring. The damper spring may be disposed between the support and the liner.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
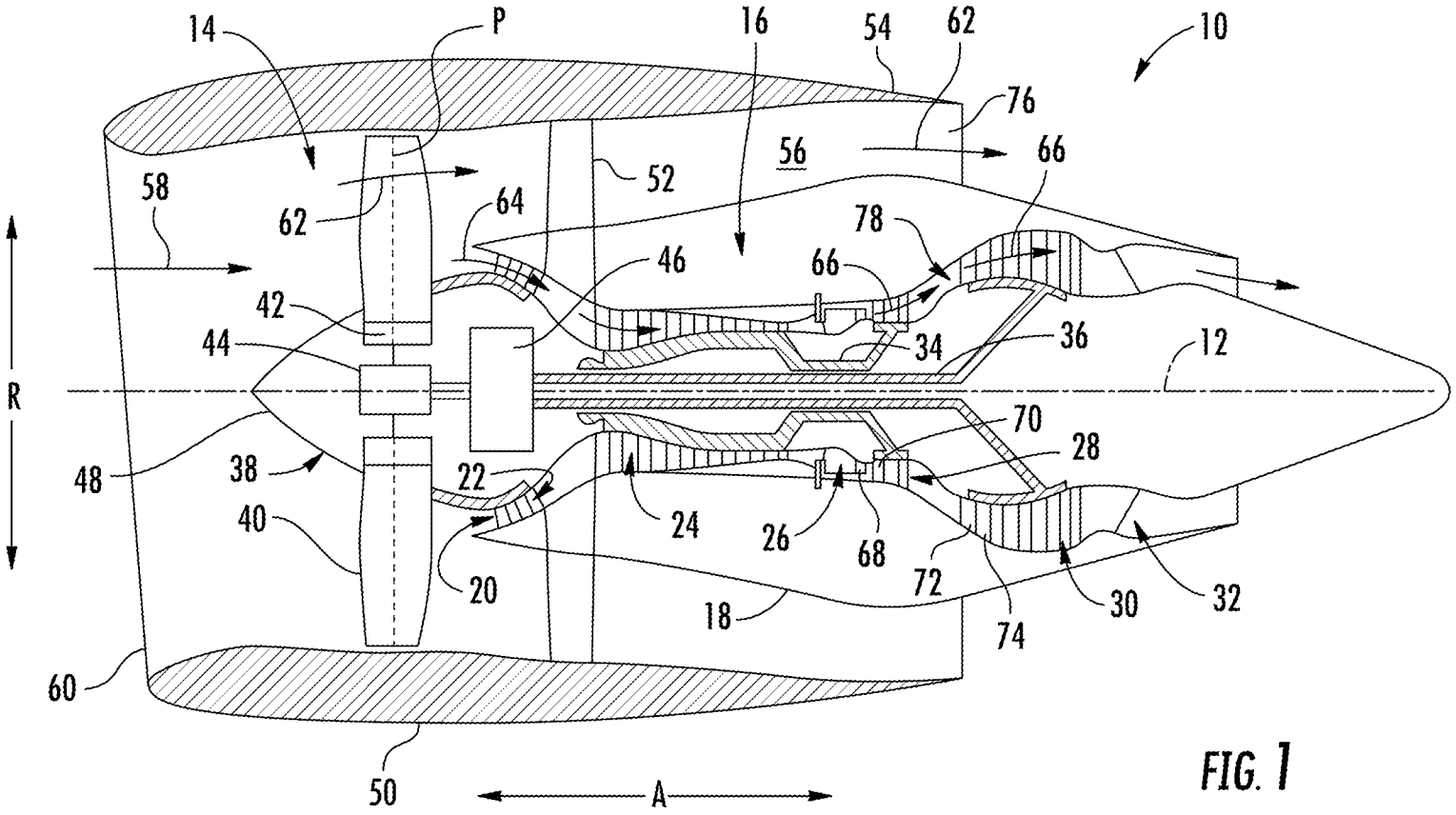
FIG. 1 provides a schematic view of an exemplary gas turbine engine in accordance with one or more embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. Terms of approximation, such as "about" or "approximately," refer to being within a ten percent margin of error.

Generally, at least one embodiment of the present disclosure provides a liner assembly surrounding a combustion section of an engine. A non-metallic liner may be provided. Moreover, one or more damper assemblies may be provided along the liner depending on the geometry and material of the liner. Optionally, the damper assembly may include a rigid frame or arm that holds a damper spring against the liner.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference) and a radial direction R. In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

For the embodiment depicted, the fan section 14 includes a variable pitch fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 by LP shaft 36 across a power gear box 46. The power gear box 46 includes a plurality of gears for stepping down the rotational speed of the LP shaft 36 to a more efficient rotational fan speed.

Referring still to the exemplary embodiment of FIG. 1, the disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that the nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters the turbofan 10 through an associated inlet 60 of the nacelle 50 and/or fan section 14. As the volume of air 58 passes across the fan blades 40, a first portion of the air 58 as indicated by arrows 62 is directed or routed into the bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

Figure 2:
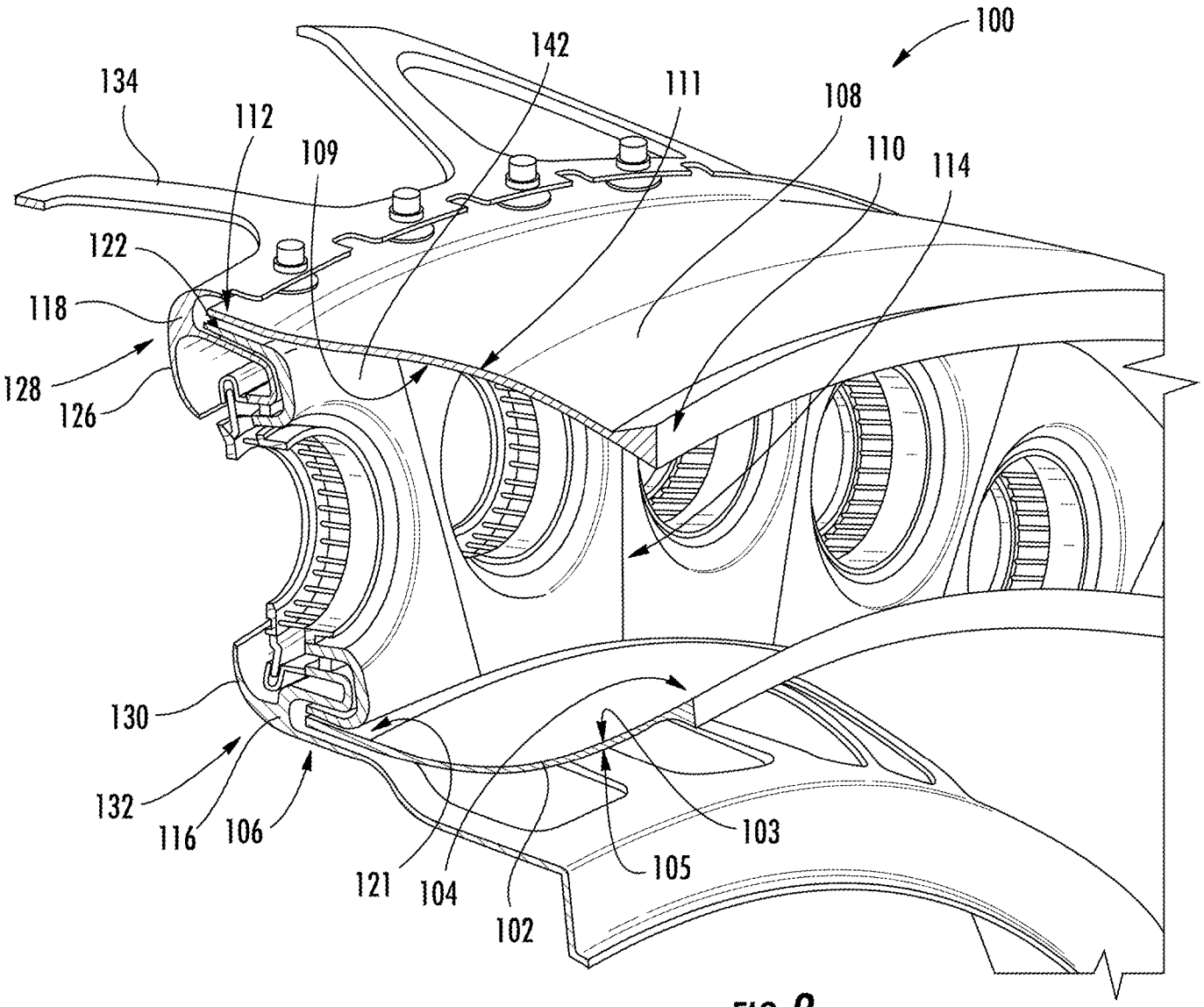
FIG. 2 provides a perspective, cross-sectional view of an exemplary combustor assembly in accordance with one or more embodiments of the present disclosure.
Figure 3:
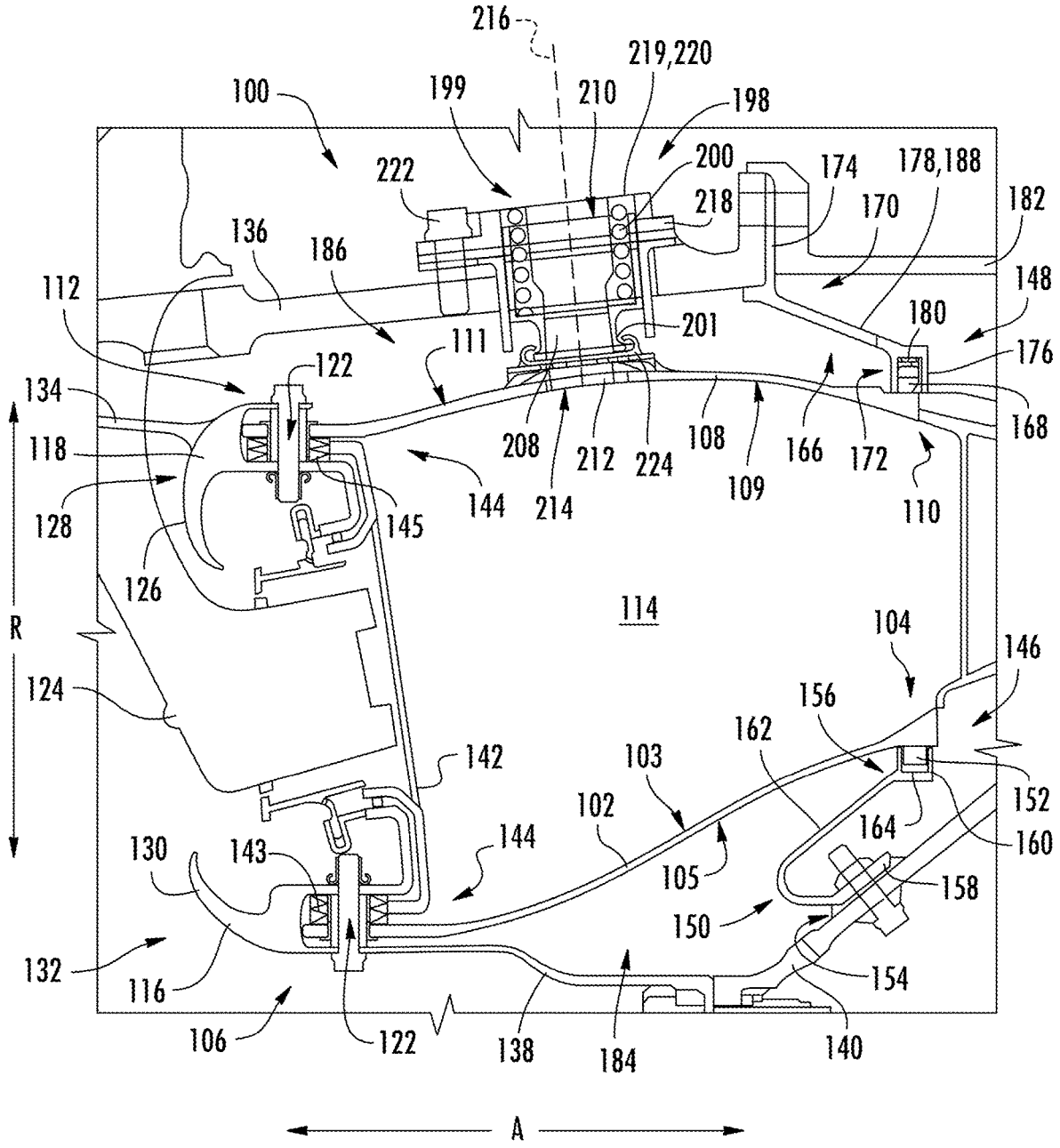
FIG. 3 is a schematic, cross-sectional view of the exemplary combustor assembly of FIG. 2.

Referring now to FIGS. 2 and 3, close-up cross-sectional views are provided of a combustor assembly 100 in accordance with an exemplary embodiment of the present disclosure. For example, the combustor assembly 100 of FIGS. 2 and 3 may be positioned in the combustion section 26 of the exemplary turbofan engine 10 of FIG. 1. More particularly, FIG. 2 provides a perspective, cross-sectional view of the combustor assembly 100 and FIG. 3 provides a side, schematic, cross-sectional view of the exemplary combustor assembly 100 of FIG. 2. Notably, the perspective, cross-sectional view of the combustor assembly 100 in FIG. 2 depicts an outer combustor casing 136 and other components removed for clarity.

As shown, the combustor assembly 100 generally includes an inner liner 102 extending between an aft end 104 and a forward end 106 along the axial direction A, as well as an outer liner 108 also extending between and aft end 110 and a forward end 112. The inner and outer liners 102, 108 together at least partially define a combustion chamber 114 therebetween. In turn, the inner liner 102 includes an inner surface 103 facing the combustion chamber 114 and an outer surface 105 facing away from the combustion chamber 114. Similarly, the outer liner 108 includes an inner surface 109 facing the combustion chamber 114 and an outer surface 111 facing away from the combustion chamber 114.

In some embodiments, one or more damper assemblies 144, 146, 148, 198 are provided to dissipate the energy associated with the dynamic excitation of the liners 102, 108. Generally, a damper assembly 144, 146, 148, 198 extends between the outer casing 136 and at least one of the liners' outer surfaces 105, 111. A separable support 134, 138, 162, 178, 201 of the damper assembly selectively holds a damper spring 143, 145, 164, 180, 200 in engagement with the liner 102, 108.

During operation of the gas turbine engine, the damper assembly 144, 146, 148, 198 may engage the liner 102, 108 at a predetermined location to provide a desired mechanical damping quality factor (Q) for one or more vibratory modes of interest. Excitations or oscillations input to and/or generated by the combustor assembly 100 will, thus, be damped according to the damping quality factor (Q) without inducing undesired stresses associated with rigid constraint. For example, the quality factor (Q) may be reduced to a value of 20 or lower, e.g., between about 0 and about 20. The location at which the damper assembly 144, 146, 148, 198, is applied may influence the damping quality associated with the dynamic strains preventing undesired levels in regions of stress concentration. Advantageously, strain and radial oscillations at the combustor assembly 100 may be restricted without significantly increasing the overall weight of the engine.

In certain embodiments, at least one damper assembly 144 is fixed to the inner or outer liner 102, 108 and included within one or more mounting component. For instance, in the exemplary embodiment of FIGS. 2 and 3, a damper assembly 144 is provided at the forward end 106 of the inner liner 102 and/or forward end 112 of the outer liner 108. In some such embodiments, the combustor assembly 100 includes an inner annular dome 116 attached to the forward end 106 of the inner liner 102 and an outer annular dome 118 attached to the forward end 112 of the outer liner 108. The inner and outer annular domes 116, 118 each define an annular slot 122 for receipt of the forward end 106 of the inner liner 102, and the forward end 112 of the outer liner 108, respectively.

In some embodiments, the combustor assembly 100 further includes a plurality of fuel air mixers 124 spaced along a circumferential direction within the outer dome 118. Additionally, the plurality of fuel air mixers 124 are disposed between the outer dome 118 and the inner dome 116 along the radial direction R. During operation, compressed air from the compressor section of the turbofan engine flows into or through the fuel air mixers 124, where the compressed air is mixed with fuel and ignited to create the combustion gases within the combustion chamber 114. The inner and outer domes 116, 118 are configured to assist in providing such a flow of compressed air from the compressor section into or through the fuel air mixers 124. For example, the outer dome 118 includes an outer cowl 126 at a forward end 128 and the inner dome 116 similarly includes an inner cowl 130 at a forward end 132. The outer cowl 126 and inner cowl 130 may assist in directing the flow of compressed air from the compressor section 26 into or through one or more of the fuel air mixers 124.

The inner and outer domes 116, 118 each include attachment portions configured to assist in mounting the combustor assembly 100 within the turbofan engine 10 (see FIG. 1). For example, the outer dome 118 includes an attachment extension 134 directed radially outward toward the outer casing 136. Optionally, the inner dome 116 includes a similar attachment extension 138 directed radially inward and configured to attach to an annular brace member 140 within the turbofan engine. In certain exemplary embodiments, the inner dome 116 may be formed integrally as a single annular component, and similarly, the outer dome 118 may also be formed integrally as a single annular component. It should be appreciated, however, that in other exemplary embodiments, the inner dome 116 and/or the outer dome 118 may alternatively be formed by one or more components joined in any suitable manner. For example, with reference to the outer dome 118, in certain exemplary embodiments, the outer cowl 126 may be formed separately from the outer dome 118 and attached to the forward end 128 of the outer dome 118 using, e.g., a welding process. Similarly, the attachment extension 134 may also be formed separately from the outer dome 118 and attached to the forward end 128 of the outer dome 118 using, e.g., a welding process. Additionally, or alternatively, the inner dome 116 may have a similar configuration.

In the illustrated embodiment, a front damper spring 143, 145 is attached to each annular dome 116, 118. Specifically, one front damper spring 143 is disposed on the inner liner 102 in operable connection with the attachment extension 138 of the inner dome 116. Another front damper spring 145 is disposed on the outer liner 108 in operable connection with the attachment extension 134 of the outer dome 118. Each front damper spring 143, 145 may be disposed on a respective liner 102, 108 either indirectly or directly, e.g., at the outer surface 105, 111. In certain embodiments, each front damper spring 143, 145 is disposed within and at least partially enclosed by a respective slot 122. Optionally, the front damper springs 143, 145 may each be configured as a discrete annular ring or ring pair. For instance, as shown in FIG. 2, an annular front damper spring 145 formed as a double cock or wave spring may substantially span the outer surface 105, 111 in a circumferential direction about the axial direction A. Each annular wave spring may be formed from one or more suitable resilient material, e.g., L605 cobalt alloy or WASPALOY® (approximately 58% Ni, 19% Cr, 13% Co, 4% Mo, 3% Ti, 1.4% Al).

Referring still to FIG. 2, the exemplary combustor assembly 100 further includes a heat shield 142 positioned around the fuel air mixer 124 depicted. The exemplary heat shield 142, for the embodiment depicted, is attached to and extends between the outer dome 118 and the inner dome 116. The heat shield 142 is configured to protect certain components of the turbofan engine 10 from the relatively extreme temperatures of the combustion chamber 114.

For the embodiment depicted, the inner liner 102 and the outer liner 108 are each formed of a ceramic matrix composite (CMC) material, which is a non-metallic material having high temperature capability and low ductility. Exemplary CMC materials utilized for such liners 102, 108 may include silicon carbide, silicon, silica or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y and combinations thereof) and inorganic fillers (e.g., pyrophyllite, wollastonite, mica, talc, kyanite and montmorillonite). By contrast, the inner dome 116, outer dome 118, and various other structural or non-structural components may be formed of a metal, such as a nickel-based superalloy or cobalt-based superalloy. Advantageously, the inner and outer liners 102, 108 may be better able to handle the extreme temperature environment presented in the combustion chamber 114.

In some embodiments, the combustor assembly 100 includes at least one inner damper assembly 146 and at least one outer damper assembly 148, respectively. The outer damper assembly 148 generally includes an outer piston ring holder 166 and an outer piston ring 168, the outer piston ring holder 166 extending between a first end 170 and a second end 172. The outer piston ring holder 166 includes a flange 174 positioned at the first end 170, a slot 176 positioned at the second end 172, and a mounting arm 178 extending from the flange 174 to the slot 176. The flange 174 of the outer piston ring holder 166 is similarly configured for attachment to a structural member positioned in or around at least a portion of the combustion section, which for the exemplary embodiment depicted is the combustor casing 136. More particularly, for the embodiment depicted, the flange 174 of the outer piston ring holder 166 is attached between the combustor casing 136 and a turbine casing 182. The slot 176 is configured for receipt of the outer piston ring 168, which extends around and contacts the aft end 110 of the outer liner 108 to form a seal with the aft end 110 of the outer liner 108.

In the embodiments of FIG. 3, one or more radial damper springs 180 are disposed within the damper assembly 146, 148. As shown, the exemplary outer damper assembly 148 is configured such that the mounting arm 178 is operably attached to the radial damper spring 180. Specifically, when assembled, the slot 176 substantially encloses the radial damper spring 180, compressing the radial damper spring 180 between the slot 176 of the outer piston ring holder 166 and the outer piston ring 168. Excitations or oscillations at the aft end 110 are, thus, absorbed by the radial damper spring 180 before being transferred to the outer casing 136 through the mounting arm 178.

In optional embodiments, a radial damper spring 180 is included provided with a predetermined stiffness coefficient to resist radial compression. For instance, the radial damper spring 180 may be formed as a resilient double cock or wave spring. The wave spring may include a radial stiffness between about 1 $lbf/in^2$ and about 5 $lbf/in^2$. Optionally, the wave spring may be formed from one or more suitable resilient material, e.g., L605 cobalt alloy or WASPALOY® (approximately 58% Ni, 19% Cr, 13% Co, 4% Mo, 3% Ti, 1.4% Al). As discussed above, the damper assembly 148 damps oscillations of the outer liner 108 in the radial direction R. Radial excitations are thus damped according to the to the predetermined quality factor (Q) of the damper assembly 148. When positioned on the aft end 110, the damper assembly 148 may engage the outer liner 108 at a predetermined location, e.g., according to a desired damping quality factor (Q).

A similar damper assembly 146 may be provided the inner liner 102. In some such embodiments, the damper assembly 146 generally includes an inner piston ring holder 150 and an inner piston ring 152. As shown, the inner piston ring holder 150 extends between a first end 154 and a second end 156. The inner piston ring holder 150 includes a flange 158 positioned at the first end 154, a slot 160 positioned at the second end 156, and a mounting arm 162 extending from the flange 158 to the slot 160. The flange 158 is configured for attachment to a structural member positioned in or around at least a portion of the combustion section, which in the exemplary embodiment depicted is the inner annular brace member 140. The slot 160 is configured for receipt of the inner piston ring 152, which extends around and contacts the aft end 104 of the inner liner 102 to form a seal with the aft end 104 of the inner liner 102.

In some such embodiments, a radial damper spring 164 is disposed within the damper assembly 146. As shown, the mounting arm 162 is operably attached to the radial damper spring 164. When assembled, the slot 160 substantially encloses the radial damper spring 164. Vibrations and oscillations at the aft end 104 are, thus, damped by the radial damper spring 164 before being transferred to the brace member 140 through the mounting arm 162.

Referring still to FIGS. 2 and 3, the inner damper assembly 146 may be optionally configured to form a seal between the combustion chamber 114 and a high pressure pass through 184 defined between the inner liner 102 and the inner annular brace member 140. Similarly, the outer damper assembly 148 may be optionally configured to form a seal between the combustion chamber 114 and a high pressure plenum 186 defined between the outer liner 108 and the combustor casing 136. Moreover, the inner and outer damper assemblies 146, 148 may accommodate an expansion of the inner and outer liners 102, 108 generally along the axial direction A, as well as generally along the radial direction R. Furthermore, in some embodiments, the inner piston ring holder 150 and the outer piston ring holder 166 are each configured as bimetallic members formed of materials configured to reduce an amount of relative thermal expansion between the inner liner 102 and the second end 156 of the inner piston ring holder 150 or the outer liner 108 and the second end 172 of the outer piston ring holder 166, respectively.

It should be noted that, although the damper assemblies 146, 148 are described as including a sealing configuration, additional or alternative damper assembly 146, 148 embodiments, including one or more mounting arms 178 and/or radial damper springs 180, may be configured at substantially any point along the outer surface 111 of the outer liner. Sealing between a damper assembly 148 and an outer liner 108 may be substantially absent. Thus, oscillations of the combustor assembly 100 in the radial direction R may be tuned at one or more point according to the predetermined quality factor (Q), without necessarily providing a sealed contact with the liner 108.

In some embodiments, for the embodiment depicted, a first portion 188 of the outer piston ring holder 166 is formed at least partially from a first material and includes the flange 174 and at least a part of the arm 178 of the outer piston ring holder 166. A second portion 190 of the outer piston ring holder 166 is formed at least partially from a discrete second material and includes the slot 176 and at least a part of the arm 178 of the outer piston holder 166. It should be appreciated, however, that the above configurations are provided by way of example only and that in other exemplary embodiments, the outer piston ring holder 166 may have any other suitable configuration.

As noted above, a radial damper spring 180 is positioned in the slot 176 of the piston holder 166 configured to press the outer piston ring 168 towards the aft end 110 of the liner 108. The radial damper spring 180 may be a single spring, or alternatively, such as in the embodiment depicted, the radial damper spring 180 may include a pair of springs. Specifically, the embodiment depicted includes a double cockle or wave spring compressed between the slot 176 of the outer piston ring holder 166 and the outer piston ring 168.

Figure 4:
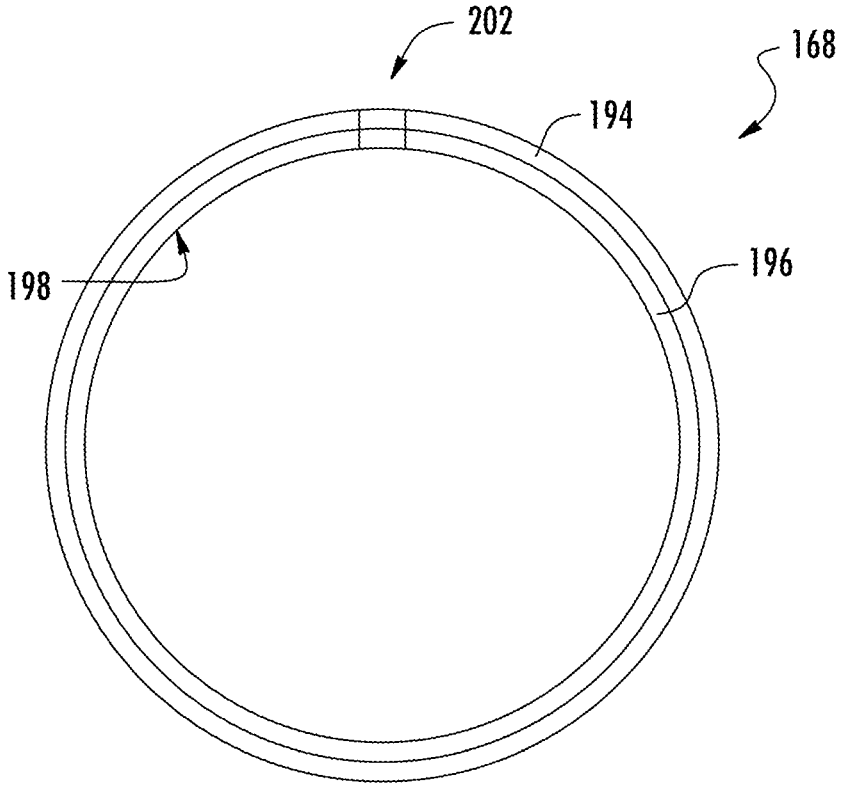
FIG. 4 is a schematic side view of a piston ring in accordance with one or more embodiments of the present disclosure.
Figure 5:
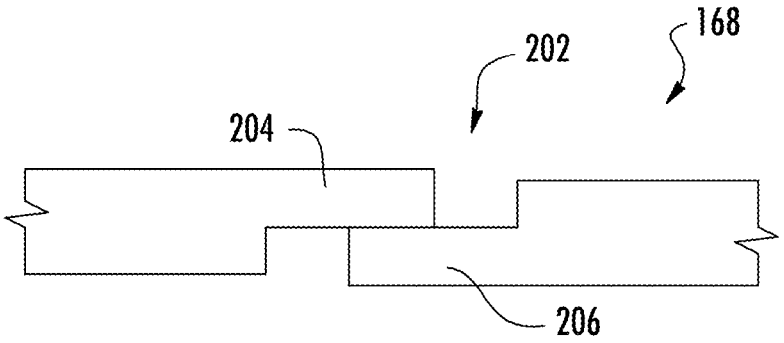
FIG. 5 is a top view of the exemplary piston ring of FIG. 4.

Referring now to FIGS. 4 and 5, an exemplary outer piston ring 168 is provided. As shown, the exemplary outer piston ring 168 additionally includes an expansion area 202 wherein a first end 204 and a second end 206 of the outer piston ring and 68 overlap. The expansion area 202 allows a diameter of the outer piston ring 168 to be increased or decreased, e.g., for installation of the outer piston ring 168 around the aft end 110 of the outer liner 108 and to accommodate thermal expansion of the outer liner 108.

As described above, an outer damper assembly 148 having such a configuration can reduce a loss of compression of the radial damper spring 180 which may otherwise occur due to the mismatch between the coefficients of thermal expansion of the outer liner 108, formed of a CMC material, and the plurality of components formed of a metal material. For example, with such a configuration, the arm 178 of the outer piston ring holder 166 of the outer damper assembly 148 may be configured to expand in a manner such that the second end 172 of the outer piston ring holder 166 remains proximate to the aft end 110 of the outer liner 108 during operation of the turbofan engine 10. Additionally, with such a configuration, the exemplary outer piston ring 168 of the outer damper assembly 148 may be configured to "self-tighten" and maintain a desired predetermined quality factor (Q). Advantageously, wear and stress concentrations may be substantially minimized across the outer liner 108.

It should be appreciated that although not depicted in greater detail, the inner damper assembly 146 depicted in FIG. 2 may be configured in substantially the same manner as the outer damper assembly 148. For example, as briefly discussed above, the inner piston ring holder 150 of the inner damper assembly 146 may be configured as a bimetallic piston ring holder including a first portion formed of a first material and a second portion formed of a second material.

As noted above, it should be appreciated that the described damper assemblies 146, 148 may be provided at various additional or alternative locations along the inner or outer liner 102, 108. A piston ring 152, 168 need not be provided, except to the extent that it supports the described arm 162, 178 and radial damper spring 164, 180 against the liner 102, 108.

Figure 6:
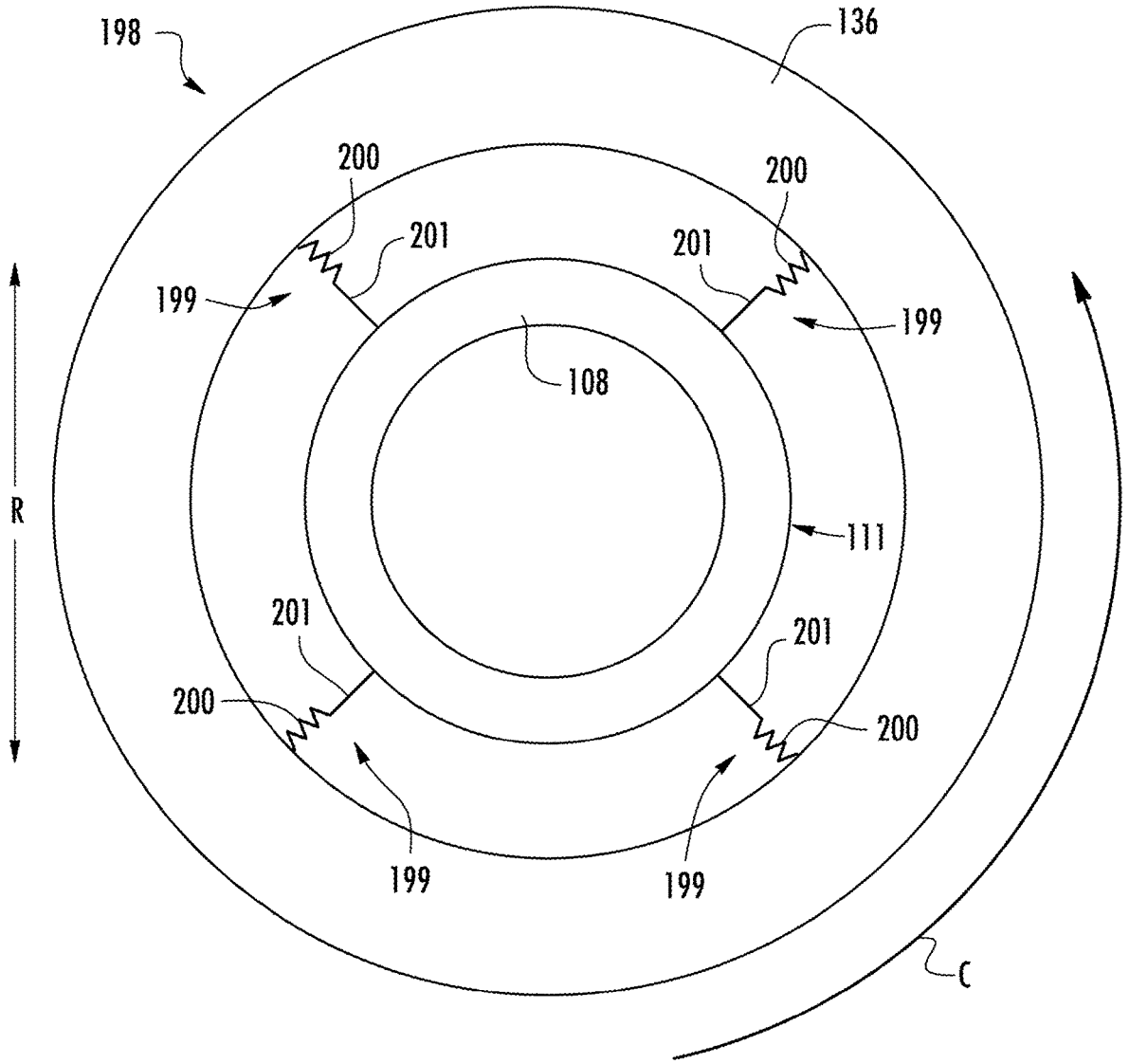
FIG. 6 is a cross-sectional schematic view of an exemplary damper assembly in accordance with one or more embodiments of the present disclosure.

Referring now to FIGS. 3 and 6, some embodiments may include a radial damper assembly 198 configured to tune oscillations at discrete radial points of the outer liner. In some embodiments the radial damper assembly 198 includes one or more pushrods 199 disposed about the outer liner 108, i.e., along the circumference of the outer liner 108. In the exemplary embodiment, the pushrod 199 includes at least one linear damper spring 200 and one spring adapter 201 engaged against the outer surface 111.

As shown in, the linear damper spring 200 and spring adapter 201 may enclose one or more rigid conduit. For instance, in the illustrated embodiment of FIG. 3, the linear damper spring 200 is disposed about a rigid igniter tube 208. Generally, the rigid igniter tube 208 extends in the radial direction through an opening 210 defined within and/or by the outer combustor casing 136. An ignition tip or tip portion 212 of the igniter tube 208 extends at least partially through an opening 214 defined within the outer liner 108. In particular embodiments, the ignition tip 212 may be concentrically aligned with respect to the opening 214 and with respect to a radial passage axis 216 of the igniter tube 208.

In the exemplary embodiment of FIG. 3, an outer housing or body 218 is further provided about at least a portion of the linear damper spring 200 and igniter tube 208. In particular embodiments, the outer housing 218 includes an opening 220 defined along a top wall 219 of the outer housing 218. The opening 220 may be sized and/or shaped for receiving the igniter tube 208 and linear damper spring 200. A portion of the igniter tube 208 may extend through and radially outwardly from the opening 220. The outer housing 218 may be configured to couple to the outer combustor casing 136 and may at least partially form a seal around opening 210. For example, the outer housing 218 may be coupled to the outer combustor casing 136 via, e.g., bolts 222 or other mechanical fastening means. Moreover, the top wall 219 of the outer housing 218 may support a radial extreme of the linear damper spring 200 stationary in relation to the outer combustor casing 136. The opposite extreme of the linear damper spring 200 may be engaged against the spring adaptor for radial movement in relation to the combustor casing 136.

As shown, the spring adaptor 201 and the igniter tube 208 are fixed to the outer liner 108. In the exemplary embodiment, the spring adaptor 201 includes an annular sleeve or retention collar 224 fixedly connected to and/or at least partially formed by the igniter tube 208 proximate to the ignition tip 212. The retention collar 224 extends outwardly from the igniter tube 208 in a direction that is generally perpendicular to the passage axis 216. When mounted to the outer combustor casing 136, the retention collar 224 is disposed between an inner surface of the outer combustor casing 136 and an outer surface 111 of the outer liner 108. In some embodiments, one or more portion of the spring adaptor is formed from a suitable resilient material, e.g., L605 cobalt alloy.

One or more of the linear damper springs may be formed as a compressible coil spring, as illustrated. Optionally, a predetermined axial stiffness constant, i.e., stiffness constant in the direction of compression, may be provided for each linear damper spring 200 to establish a known damper characteristic during operation. In one embodiment the linear damper spring 200 includes an axial stiffness constant between about 100 lbf/in and about 200 lbf/in for compression along the radial passage axis 216. Each linear damper spring 200 may be formed from one or more suitable elastic material, such as a resilient nickel alloy, e.g., AMS 5800 (Rene 41).

As illustrated in FIG. 6, a plurality of discrete pushrods 199 and corresponding spring adaptors may be disposed against the outer liner 108 at various circumferential points. The circumferential and/or axial positioning of each pushrod 199 may be predetermined according to a desired damping quality factor (Q) at one or more point along the outer liner 108. During operation, the discrete pushrods 199 may advantageously limit or restrict elliptical or otherwise non-circular excitations of the combustor assembly. It should be noted that although four discrete pushrods 199 are illustrated at FIG. 6, optional embodiments may include greater or fewer pushrods 199 according to the desired quality factor (Q).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a gas turbine engine including an outer casing, the gas turbine engine defining an axial direction and a radial direction, the combustor assembly comprising:

an outer liner at least partially defining a combustion chamber extending between an aft end and a forward end generally along the axial direction within the outer casing, the outer liner including an inner surface facing the combustion chamber and an outer surface facing away from the combustion chamber toward the outer casing; and a radial damper assembly disposed against the outer liner at a plurality of circumferential points, the radial damper assembly including at least one spring enclosing a rigid conduit disposed at one of the plurality of circumferential points, the at least one spring extending through an entire radial thickness of the outer casing, wherein the radial damper assembly is configured to tune oscillations at each of the plurality of circumferential points, wherein the radial damper assembly includes a radial pushrod disposed in engagement with the outer surface of the outer liner to damp oscillations in the radial direction.

2. The combustor assembly of claim 1, wherein the at least one spring is a compressible spring having an axial stiffness constant between about 100 lbf/in and 200 lbf/in, and wherein the radial pushrod includes the compressible spring.

3. The combustor assembly of claim 1, wherein the at least one spring is a linear damper spring, and wherein the radial pushrod includes the linear damper spring.

4. The combustor assembly of claim 3, wherein the linear damper spring includes a compressible coil spring.

5. The combustor assembly of claim 4, wherein the radial pushrod includes a spring adapter that is engaged against the outer surface of the outer liner.

6. The combustor assembly of claim 5, wherein the linear damper spring and the spring adapter enclose the rigid conduit.

7. The combustor assembly of claim 6, wherein the rigid conduit is an igniter tube that extends in the radial direction through an opening defined by the outer casing.

8. The combustor assembly of claim 1, wherein the radial damper assembly includes a plurality of radial pushrods and spring adaptors that are disposed against the outer surface of the outer liner at various discrete circumferential points.

9. The combustor assembly of claim 1, wherein the radial damper assembly is disposed against the outer liner at four discrete locations.

10. The combustor assembly of claim 1, wherein the radial damper assembly is further configured to tune oscillations at each of the plurality of circumferential points according to a predetermined quality factor.

11. The combustor assembly of claim 10, wherein the predetermined quality factor is a desired mechanical damping quality factor for one or more vibratory modes of interest.

12. The combustor assembly of claim 10, wherein the predetermined quality factor is between 0 and 20.

13. The combustor assembly of claim 1, wherein the at least one spring extends from a first end disposed radially exterior to an exterior surface of the outer casing to a second end disposed radially interior to an interior surface of the outer casing.

14. The combustor assembly of claim 1, wherein the at least one spring extends from an outer housing disposed radially exterior to an exterior surface of the outer casing to a spring adaptor disposed radially interior to an interior surface of the outer casing.

15. A gas turbine engine including an outer casing, the gas turbine engine defining an axial direction and a radial direction, the gas turbine engine comprising:

a compressor section;

a turbine section mechanically coupled to the compressor section through a shaft; and a combustor assembly disposed between the compressor section and the turbine section, the combustor assembly comprising:

an outer liner at least partially defining a combustion chamber extending between an aft end and a forward end generally along the axial direction within the outer casing, the outer liner including an inner surface facing the combustion chamber and an outer surface facing away from the combustion chamber toward the outer casing; and a radial damper assembly disposed between the outer casing and the outer surface of the outer liner at a plurality of circumferential points, the radial damper assembly including at least one spring enclosing a rigid conduit disposed at one of the plurality of circumferential points, the at least one spring extending through an entire radial thickness of the outer casing, wherein the radial damper assembly is configured to tune oscillations at each of the plurality of circumferential points, wherein the radial damper assembly includes a radial pushrod disposed in engagement with the outer surface of the outer liner to damp oscillations in the radial direction.

16. The gas turbine engine of claim 15, wherein the at least one spring is a compressible spring having an axial stiffness constant between about 100 lbf/in and 200 lbf/in, and wherein the radial pushrod includes the compressible spring.

17. The gas turbine engine of claim 15, wherein the at least one spring is a linear damper spring, and wherein the radial pushrod includes the linear damper spring.

18. The gas turbine engine of claim 15, wherein the radial damper assembly includes a plurality of pushrods and spring adaptors that are disposed against the outer surface of the outer liner at various discrete circumferential points.

19. The gas turbine engine of claim 15, wherein the radial damper assembly is disposed against the outer liner at four discrete locations.

20. A combustor assembly for a gas turbine engine including an outer casing, the gas turbine engine defining an axial direction and a radial direction, the combustor assembly comprising:

an outer liner at least partially defining a combustion chamber extending between an aft end and a forward end generally along the axial direction within the outer casing, the outer liner including an inner surface facing the combustion chamber and an outer surface facing away from the combustion chamber toward the outer casing; and a radial damper assembly disposed against the outer liner at a plurality of circumferential points, wherein the radial damper assembly comprises a radial pushrod disposed in engagement with the outer surface of the outer liner to damp oscillations in the radial direction, wherein the radial pushrod comprises a linear damper spring that includes a compressible coil spring, the compressible coil spring extending through an entire radial thickness of the outer casing, and wherein the linear damper spring encloses a rigid conduit disposed at one of the plurality of circumferential points.

* * * * *